US006791302B2

(12) United States Patent
Tang et al.

(10) Patent No.: US 6,791,302 B2
(45) Date of Patent: Sep. 14, 2004

(54) METHODS AND APPARATUS FOR OPEN-LOOP ENHANCED CONTROL OF POWER SUPPLY TRANSIENTS

(75) Inventors: Benjamim Tang, Hawthorne, CA (US); Keith Bassett, Torrance, CA (US); Tim Ng, Monterey Park, CA (US); Kenneth A. Ostrom, Palos Verdes, CA (US); Nicholas Steffen, Redondo Beach, CA (US); Cliff Duong, Fountain Valley, CA (US)

(73) Assignee: Primarion, Inc., Tempe, AZ (US)

( * ) Notice: Subject to any disclaimer, the term of this patent is extended or adjusted under 35 U.S.C. 154(b) by 0 days.

(21) Appl. No.: 10/104,833

(22) Filed: Mar. 21, 2002

(65) Prior Publication Data

US 2002/0175747 A1 Nov. 28, 2002

Related U.S. Application Data

(60) Provisional application No. 60/277,706, filed on Mar. 21, 2001, and provisional application No. 60/277,560, filed on Mar. 21, 2001.

(51) Int. Cl.[7] ..... G05F 1/618

(52) U.S. Cl. ..... 323/272; 323/274

(58) Field of Search ..... 361/111, 112, 361/18; 219/661, 663, 665; 363/95, 97, 17; 323/293, 234, 265, 285, 266, 268, 280, 284, 222, 286

(56) References Cited

U.S. PATENT DOCUMENTS 5,418,707 A * 5/1995 Shimer et al. ..... 363/65
5,629,608 A 5/1997 Budelman
5,767,747 A * 6/1998 Pricer ..... 331/46
6,255,635 B1 * 7/2001 Thompson et al. ..... 219/663

* cited by examiner

*Primary Examiner*—Rajnikant B Patel
(74) *Attorney, Agent, or Firm*—Theodore E. Galanthay

(57) ABSTRACT

A system is provided for supplying current to a dynamic load subject to transient current requirements. A sense unit coupled to the dynamic load is configured to sense the rate of change of supply current required by the dynamic load during a transient event. A current source coupled to the sense unit is configured to supply a current pulse to the dynamic load in response to the sense unit determining that the rate of change of supply current (di/dt) exceeds a predetermined threshold. The current pulse preferably has a shape characterized by a first region and a second region subsequent to the second region, wherein the first region includes a first boost current which exceeds the transient current requirement, and wherein the second region includes a second boost current which is less than the transient current requirement. More generally, a wideband transient suppression system is provided for controlling a wide spectrum of transients. The wideband system includes a primary regulator configured to compensate for low frequency transients, and a secondary regulator configured to provide short-term compensation current to the dynamic load until the relatively slow primary regulator can accommodate the transient event. The secondary regulator includes two major functional blocks: a close-loop voltage-sensing compensation circuit configured to compensate for transients falling within a mid-range frequency range, and an open-loop di/dt-sensing compensation circuit configured to compensate for transients falling within a high-frequency range.

24 Claims, 18 Drawing Sheets

METHODS AND APPARATUS FOR OPEN-LOOP ENHANCED CONTROL OF POWER SUPPLY TRANSIENTS

CROSS-REFERENCE TO RELATED APPLICATIONS

This application claims priority from U.S. Provisional Application Serial No. 60/277,706, filed Mar. 21, 2001; U.S. Provisional Application Serial No. 60/277,560, filed Mar. 21, 2001; U.S. Provisional Serial No. 60/361,976, filed Mar. 6, 2002, entitled "Method and Apparatus for Closed-Loop Multisensing Transient Power Regulation"; and U.S. patent application Ser. No. 09/945,187, filed Aug. 31, 2001.

BACKGROUND OF THE INVENTION

1. Technical Field

The present invention relates, generally, to microelectronic devices and, more particularly, to methods for controlling power supply transients.

2. Background Information

Recent advances in digital integrated circuits have dramatically increased the speed and density of such circuits, giving rise to many challenges related to, among other things, degradation in waveform quality. In particular, as clock rates and circuit density increase, a significant amount of transient current must be supplied to charge and discharge the internal capacitive load of each signal. These severe current transients, if not adequately filtered or regulated, result in supply and ground "bounce" and, consequently, introduce bit errors into the digital logic through degraded noise margin and supply-induced timing violations.

Prior art methods for controlling transient current requirements are unsatisfactory in a number of respects. For example, it is known that supply and ground bounce can be mitigated through the use of voltage regulation, internal and external capacitive bypassing, and low-inductance and/or low-resistance pins. However, there are fundamental limits on how much regulation and bypassing can be performed before negatively impacting system cost and complexity.

FIG. 1 depicts a prior art circuit requiring current compensation. Specifically, the supply voltage 102 passes through a voltage regulator 104. Dynamic load 112 is connected in parallel with a bypass capacitor 110 to the voltage regulator via supply inductor 106 and ground inductor 108. A compensating current may be provided to dynamic load 112 such that the droop or spike amplitude during a transient event can be minimized until the external regulator 104 can accommodate the change in load current. If the compensating current can be made to exactly match the change in dynamic load 112, and can be applied without delay, then, in theory, the transient current experienced by dynamic load 112 can be cancelled and the droop or spike can be eliminated. In practical implementations, however, the current amplitude and duration will not exactly match, and there will be a significant delay from when the change in dynamic load is sensed and when the compensating current can be applied.

One approach to matching the current amplitude and duration is to use closed-loop control of the current generator. In this approach, either the net dynamic load or supply voltage is monitored and feedback is used to set the current compensation. This approach suffers from many drawbacks. For example, in order for a closed-loop arrangement to be stable, the bandwidth of the loop must be limited such that the loop stability criteria can be met. This results in a relatively slow response to transients and little if any suppression of the critical high frequency components.

Systems and methods are therefore needed to overcome these and other limitations of the prior art.

BRIEF SUMMARY OF THE INVENTION

The present invention overcomes the limitations of the prior art by providing a system for supplying current to a dynamic load subject to transient current requirements. In accordance with one embodiment of the present invention, one or more sense units coupled to the dynamic load are configured to sense the rate of change of supply current required by the dynamic load during a transient event. One or more current sources coupled to the sense unit are configured to supply a current pulse to the dynamic load in response to the sense unit determining that the rate of change of supply current (di/dt) exceeds a predetermined threshold. The current pulse preferably has a shape characterized by a first region and a second region subsequent to the second region, wherein the first region includes a relatively low-duration first boost current which exceeds the transient current requirement, and wherein the second region includes a longer-duration second boost current which is less than the transient current requirement.

In accordance with another aspect of the present invention, a wideband transient suppression system includes a primary regulator configured to compensate for low frequency transients, and a secondary regulator configured to provide short-term compensation current to the dynamic load until the relatively slow primary regulator can accommodate the transient event. The secondary regulator includes two major functional blocks: a closed-loop voltage-sensing compensation circuit configured to compensate for transients falling within a mid-range frequency range, and an open-loop di/dt-sensing compensation circuit configured to compensate for transients falling within a high-frequency range.

In accordance with another aspect of the present invention, the first region of the current pulse is the result of an open-loop response to transient current requirements.

In accordance with another aspect of the present invention, the second region of the current pulse is the result of a closed-loop response to transient current requirements.

In accordance with an alternate embodiment of the present invention, multiple sense units and current sources are provided, each having associated delay times and/or thresholds.

BRIEF DESCRIPTION OF THE DRAWING FIGURES

The present invention is illustrated by way of example and not limitation in the accompanying figures, in which FIG. 1 is a schematic overview of a typical prior art active compensation scheme;

Figure 5:
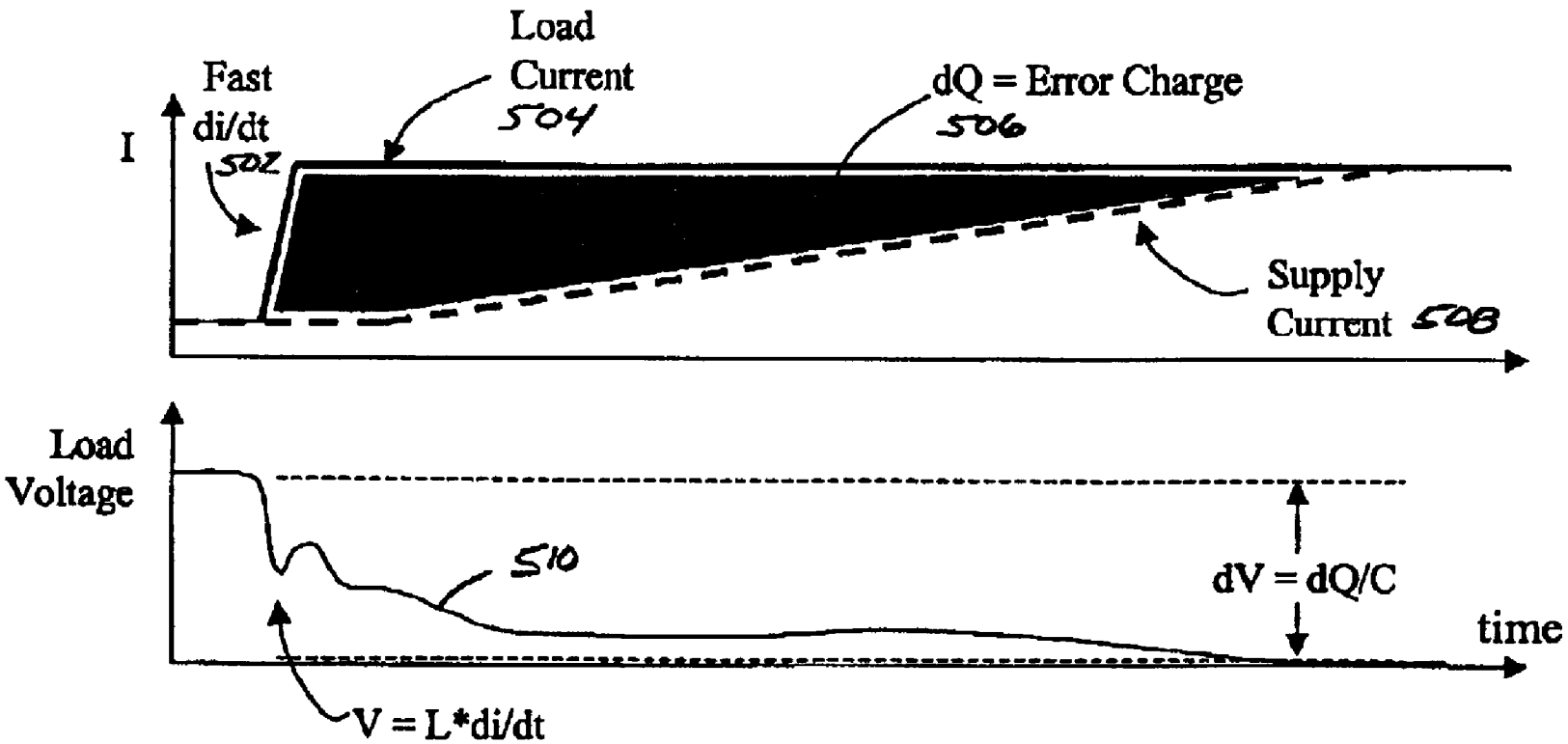
Figure 6:
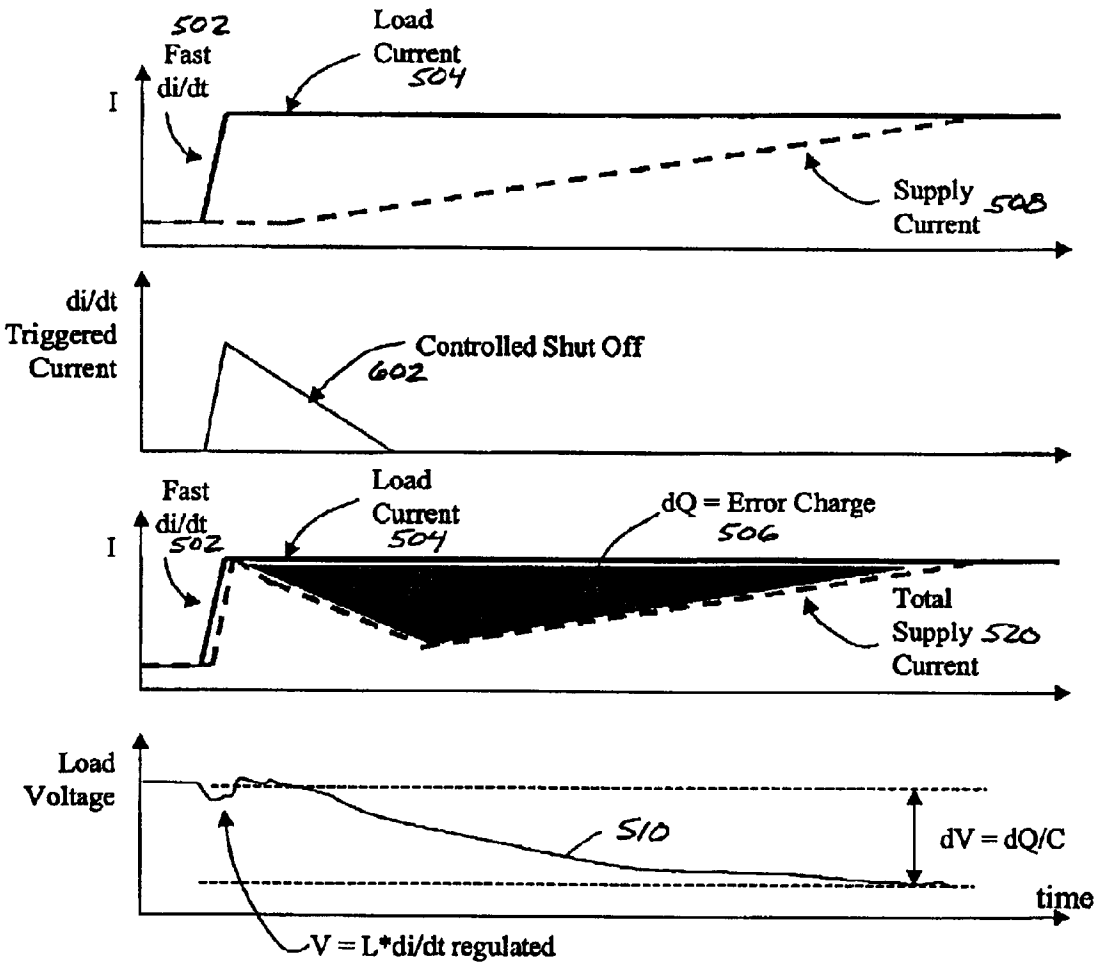
Figure 7:
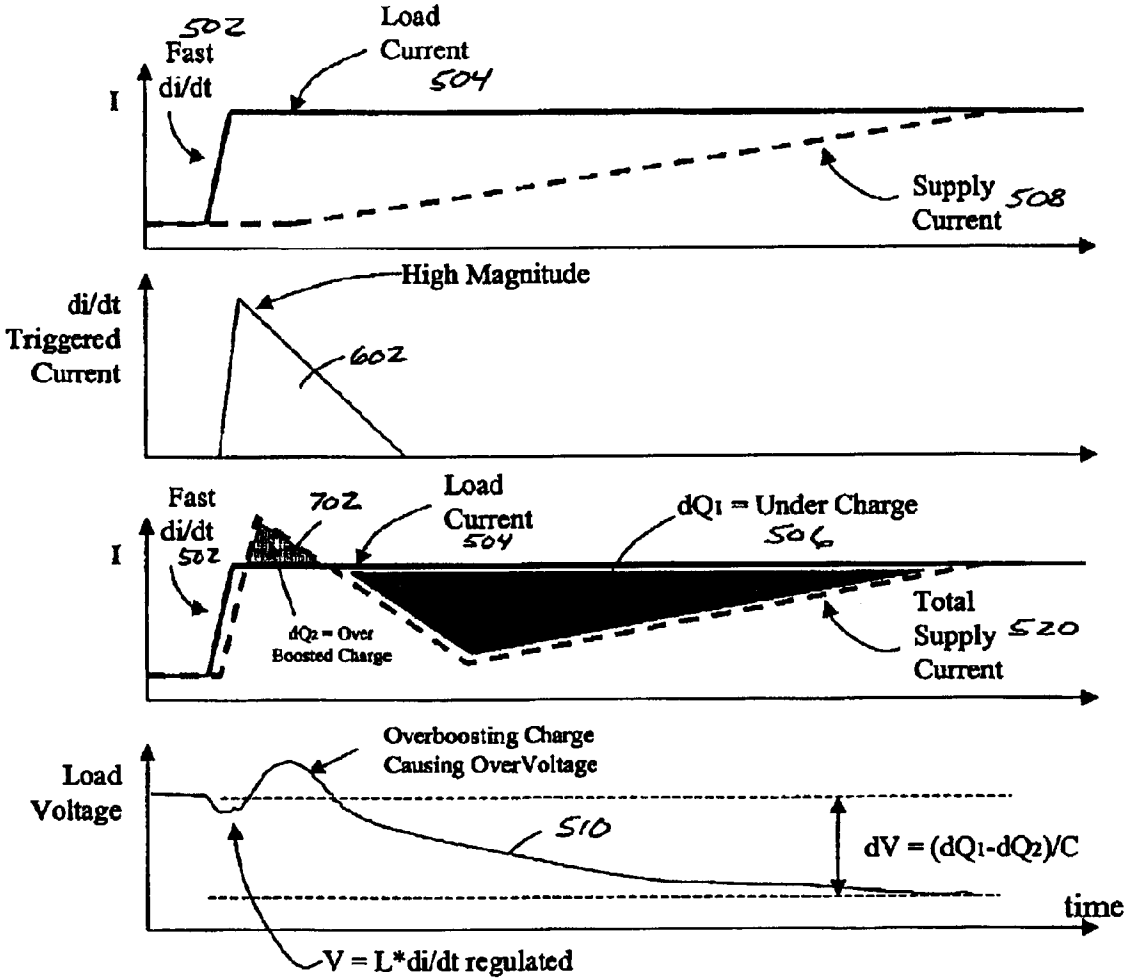
Figure 8:
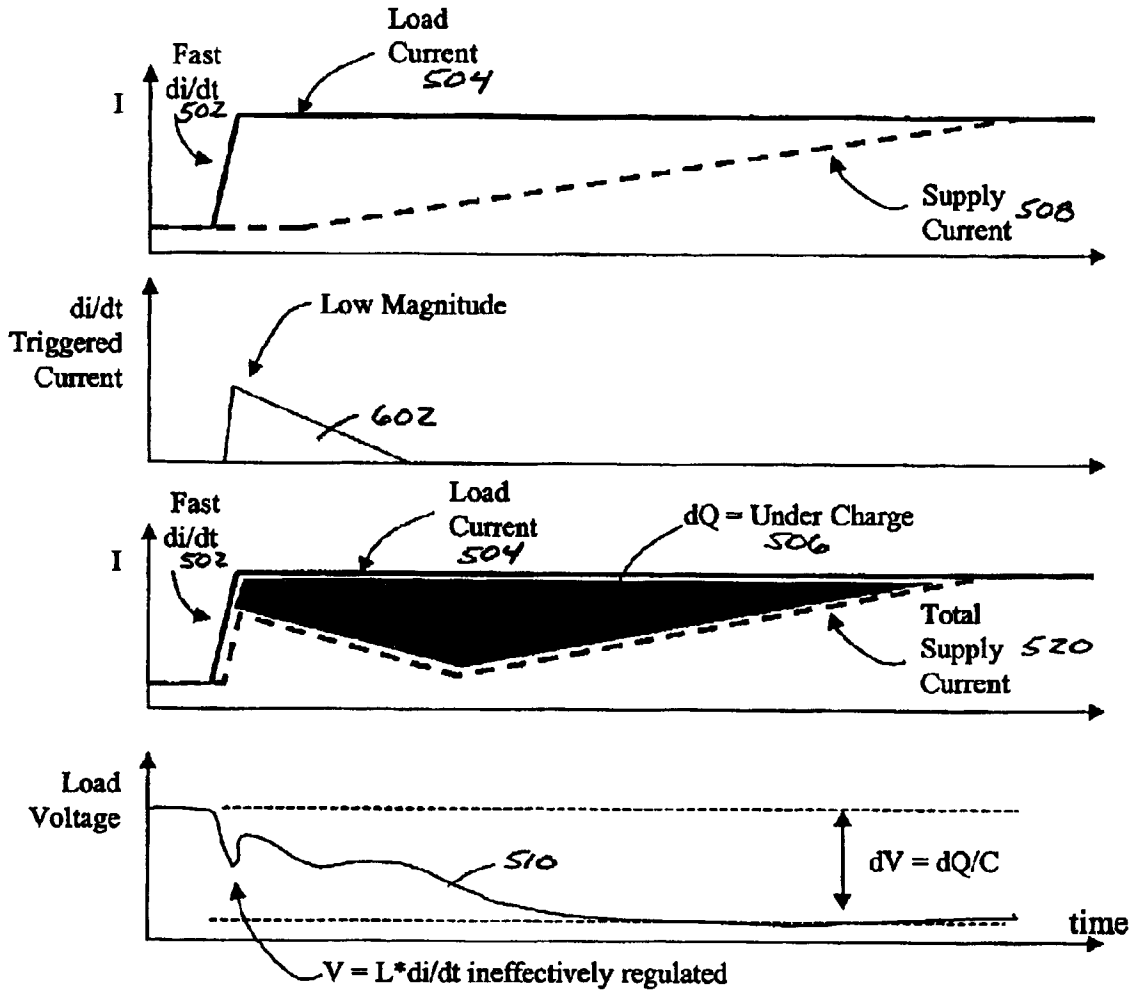
Figure 9:
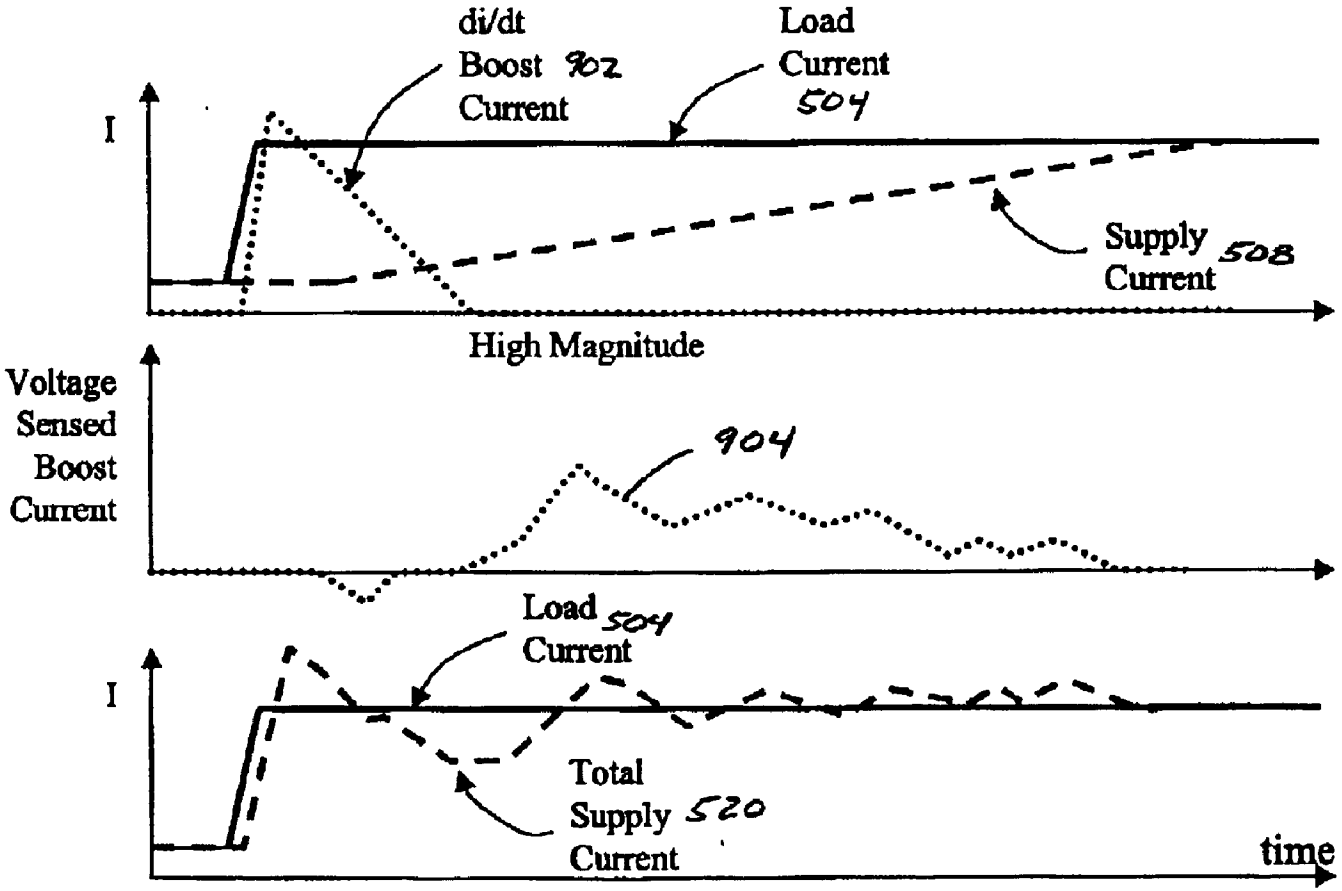
Figure 10:
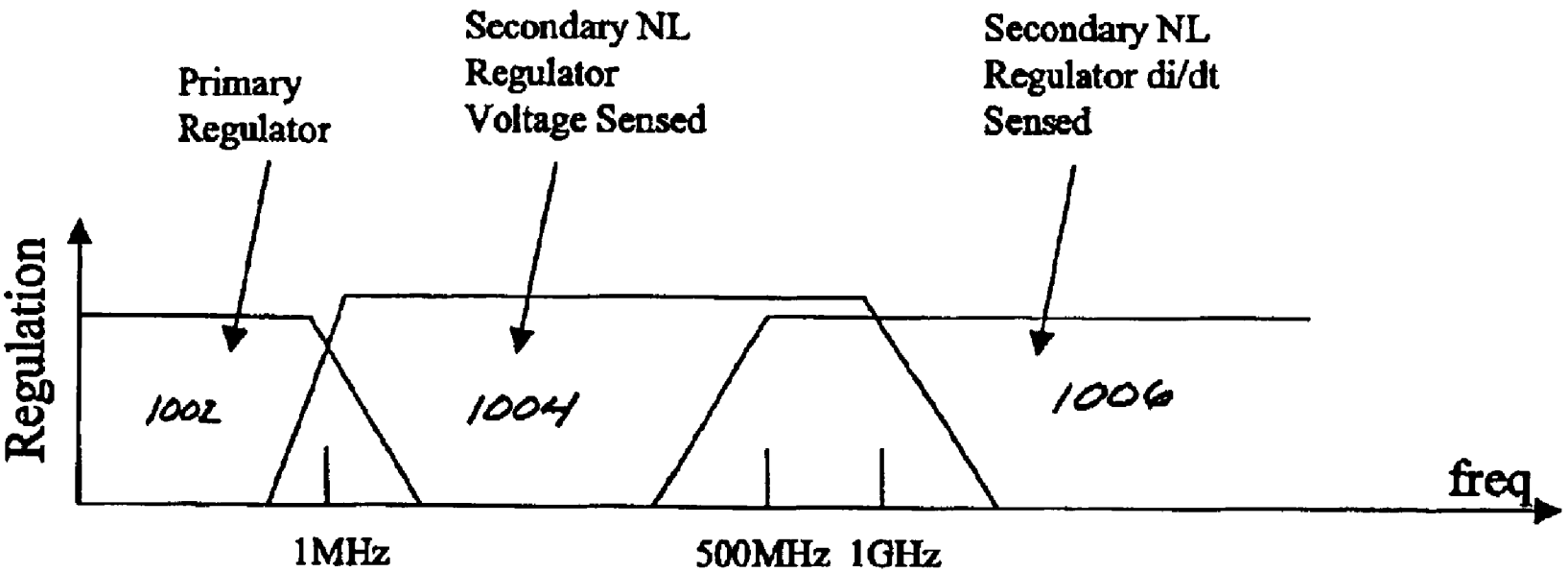
Figure 11:
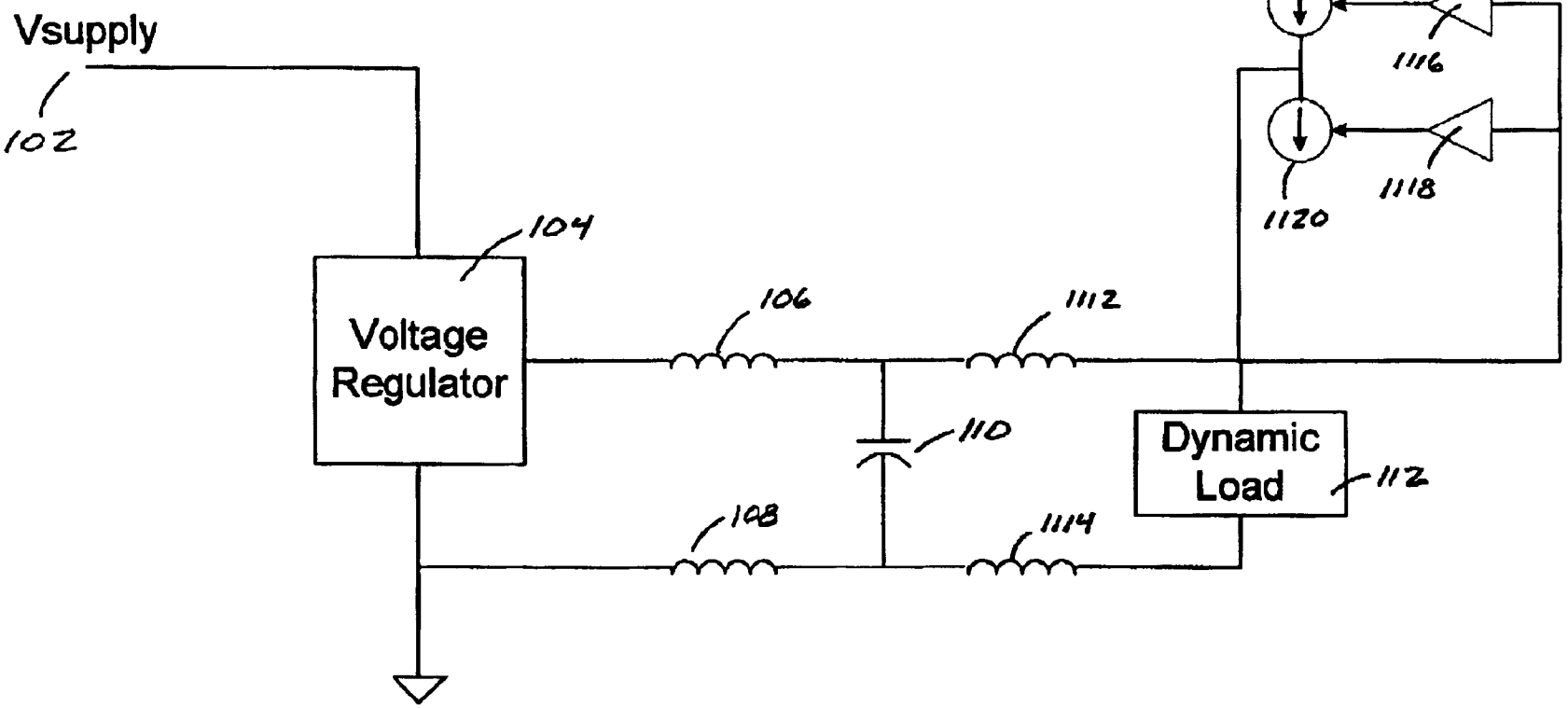
Figure 12:
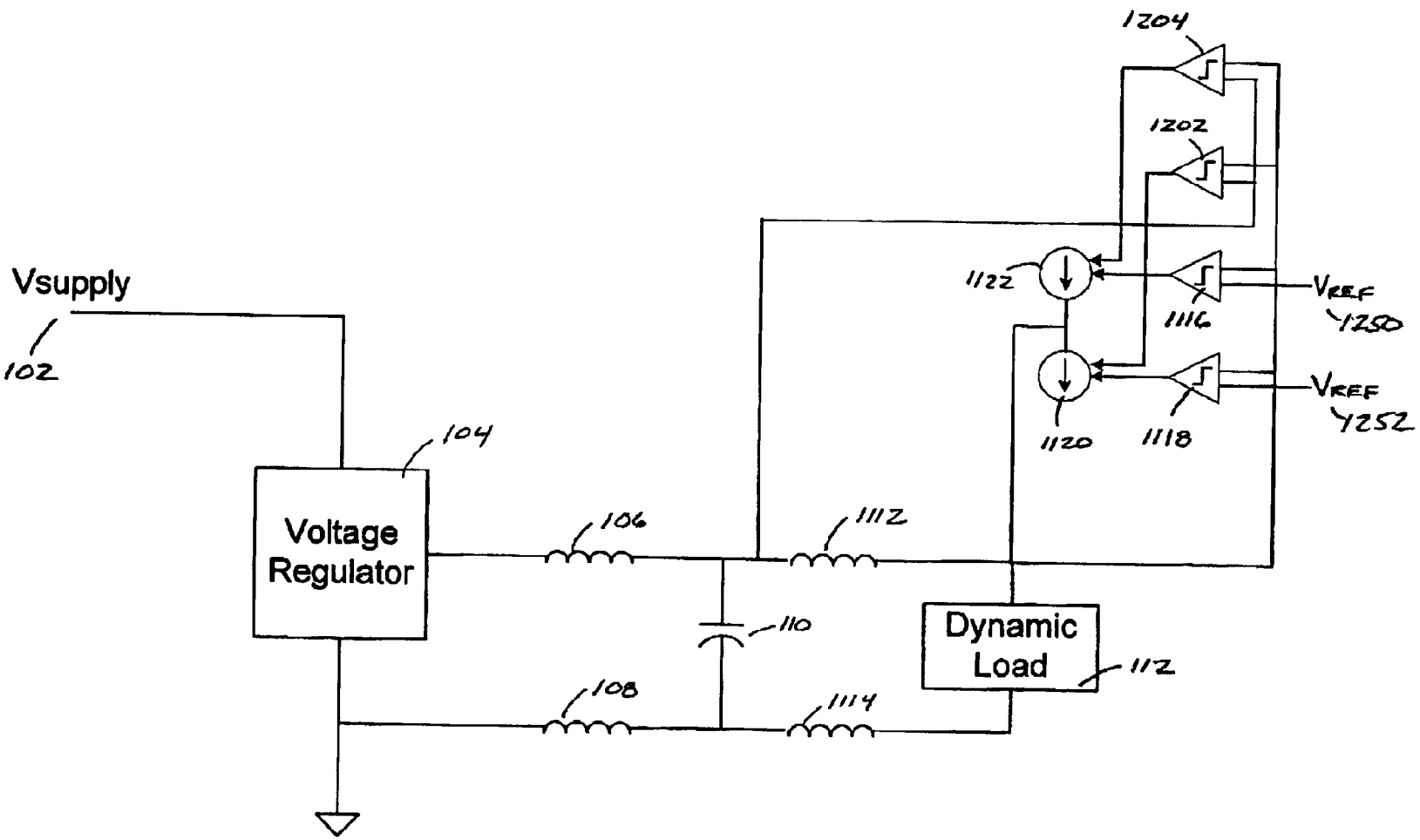
Figure 13:
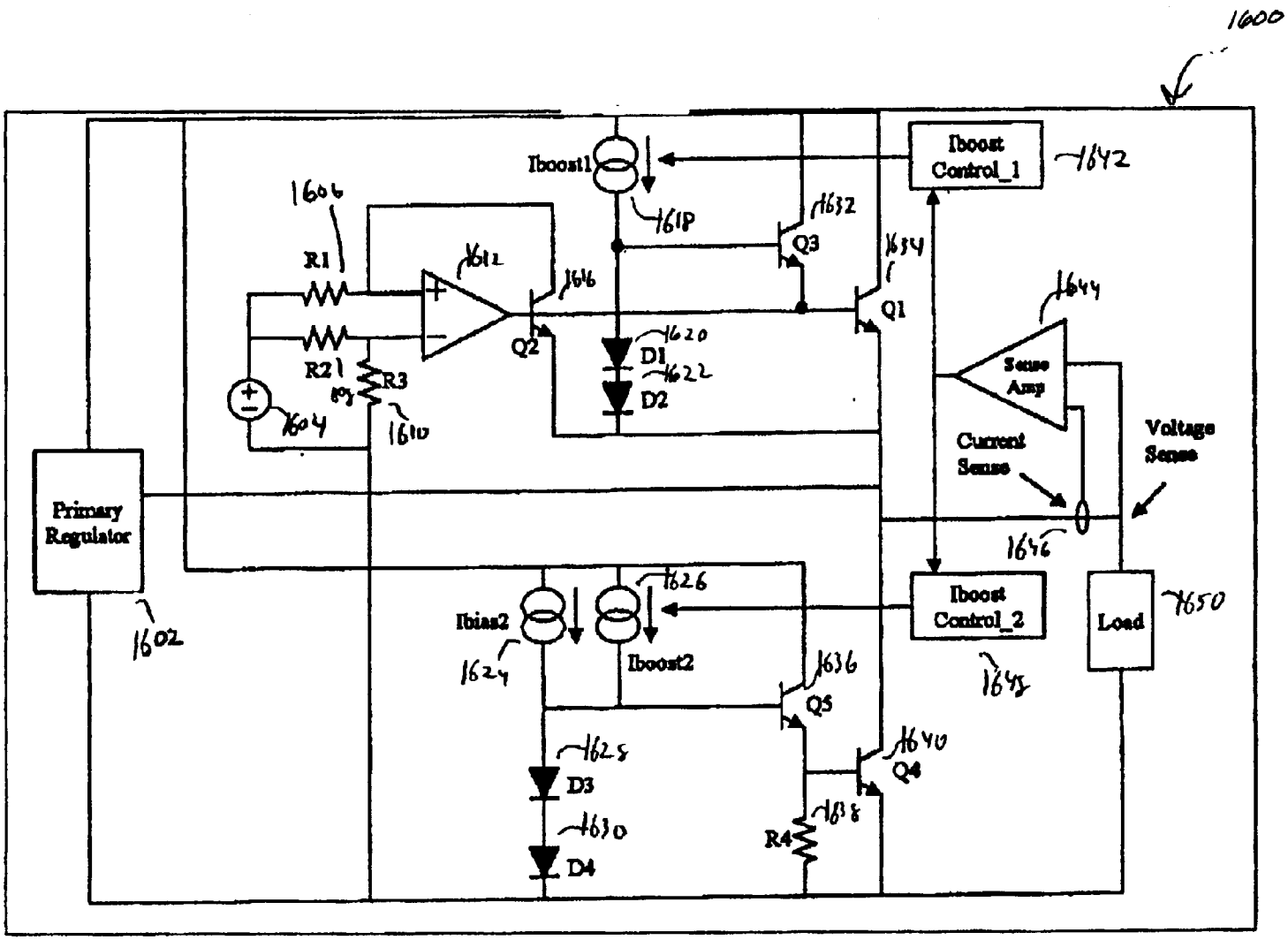
Figure 14:
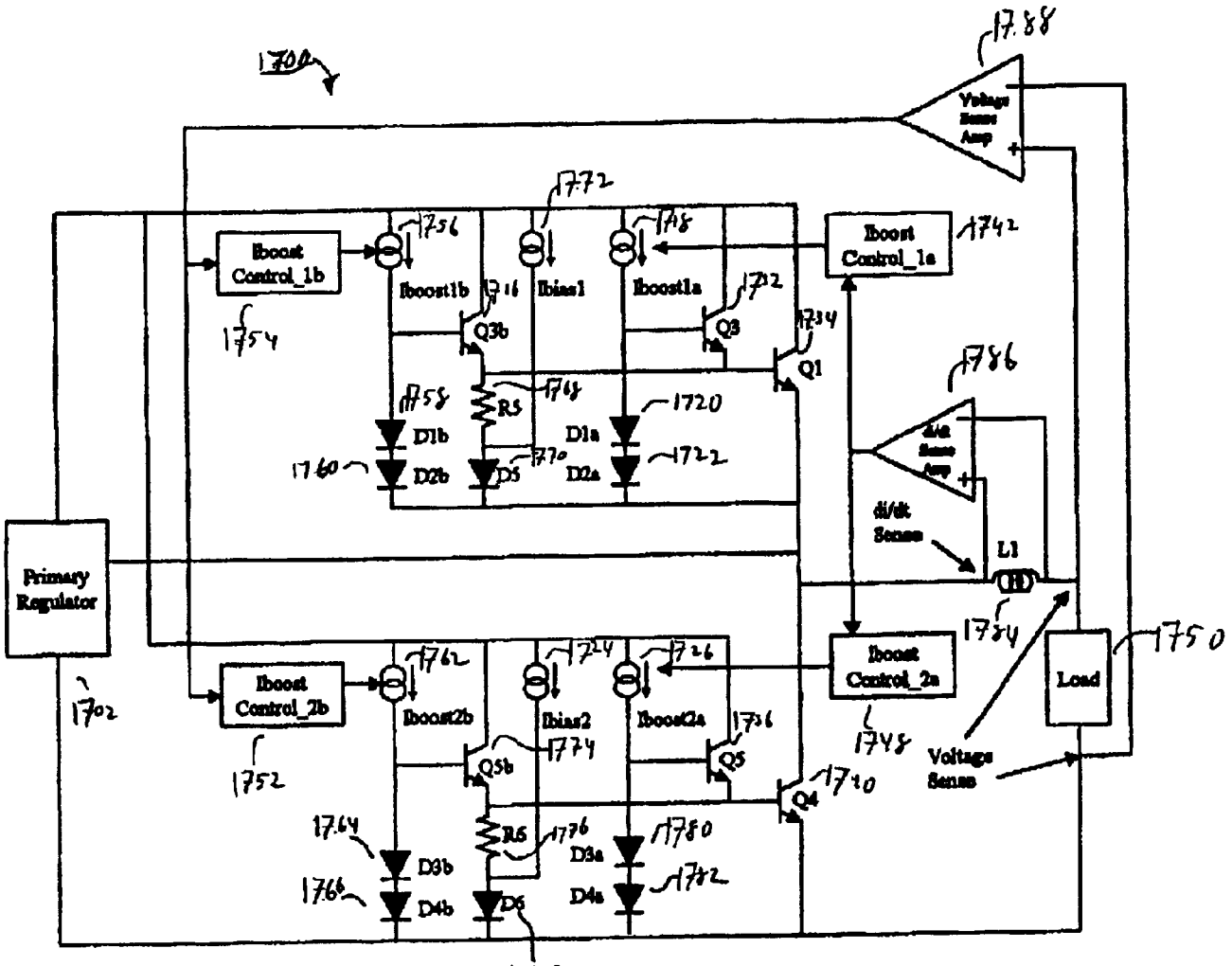
Figure 15:
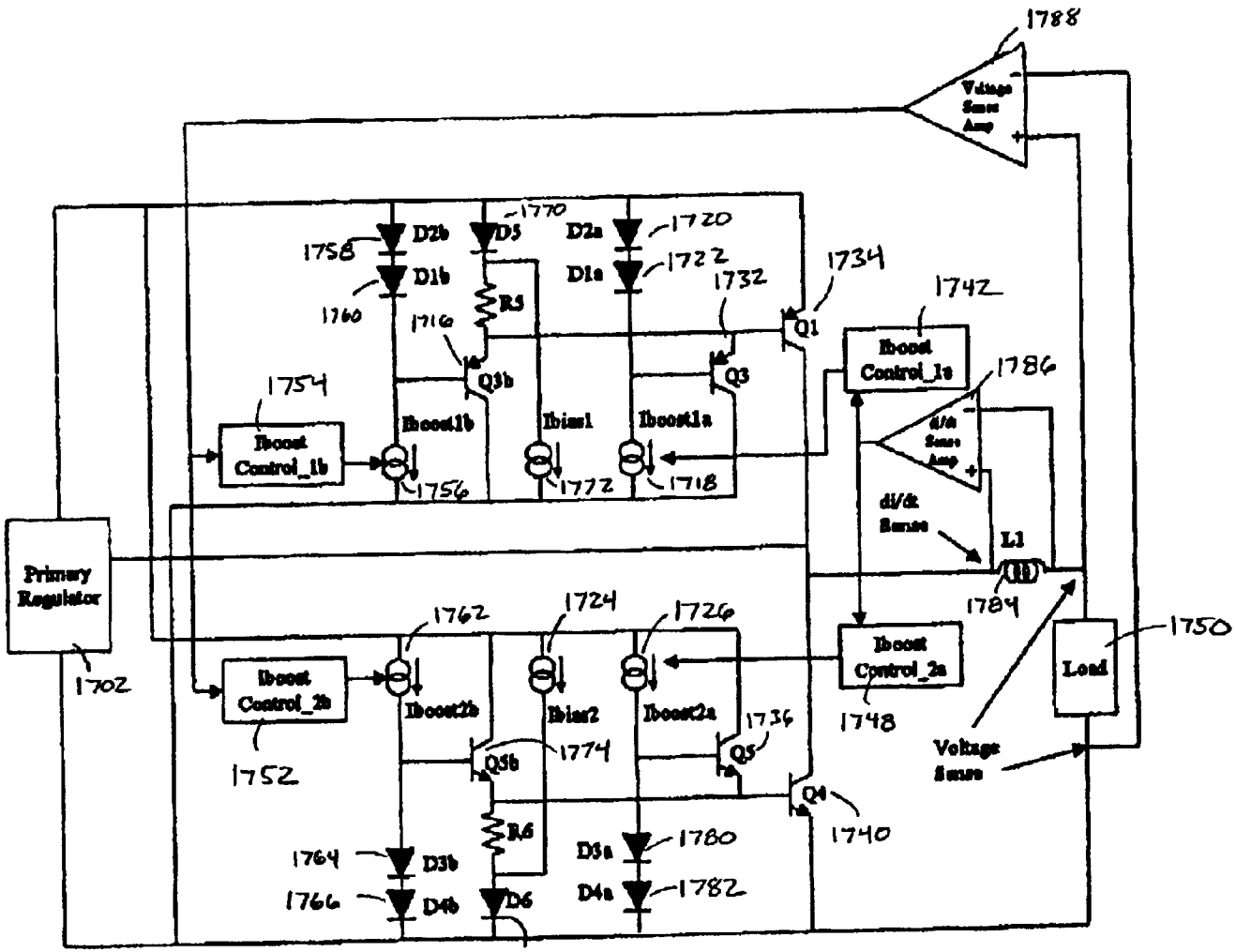
Figure 16:
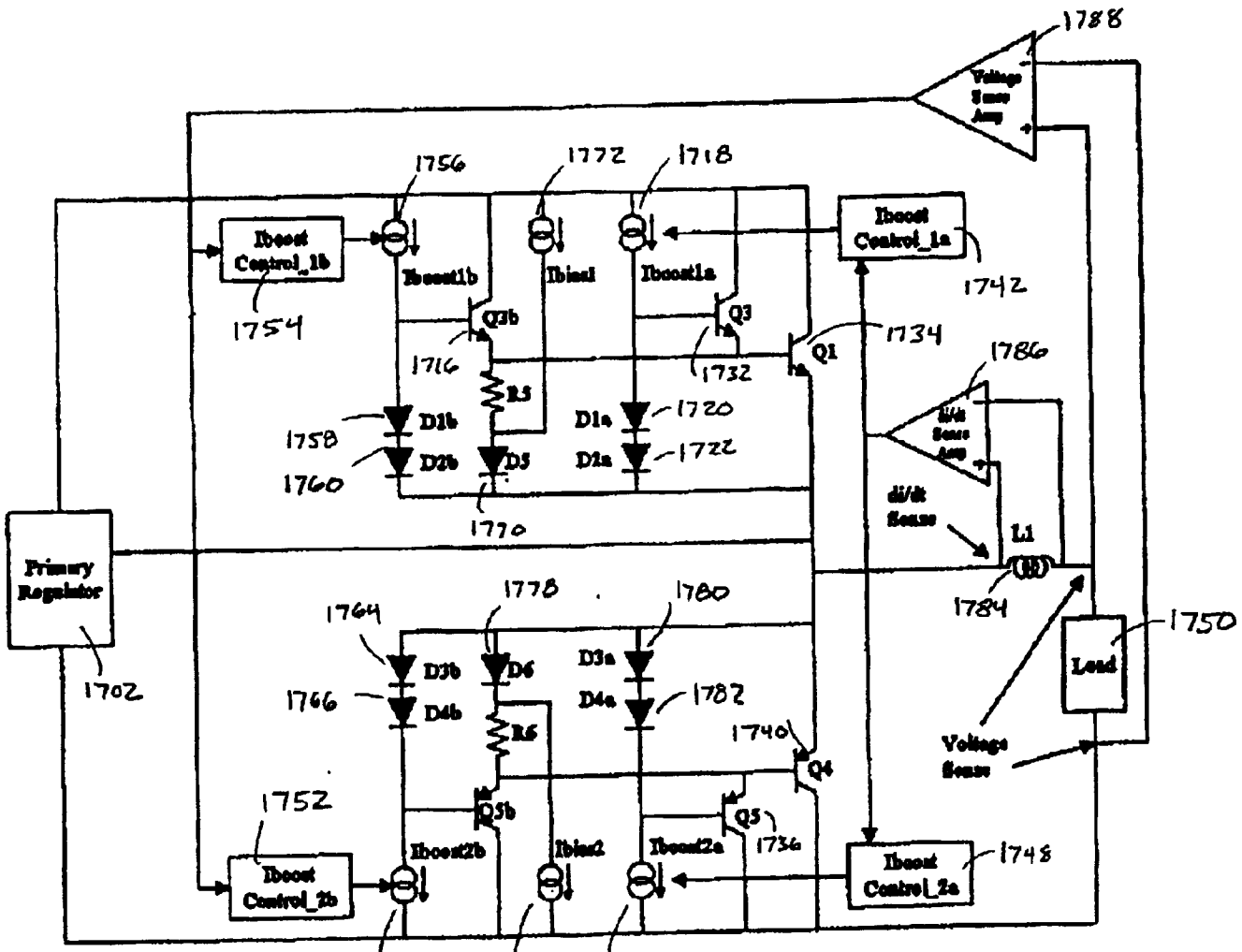
Figure 17:
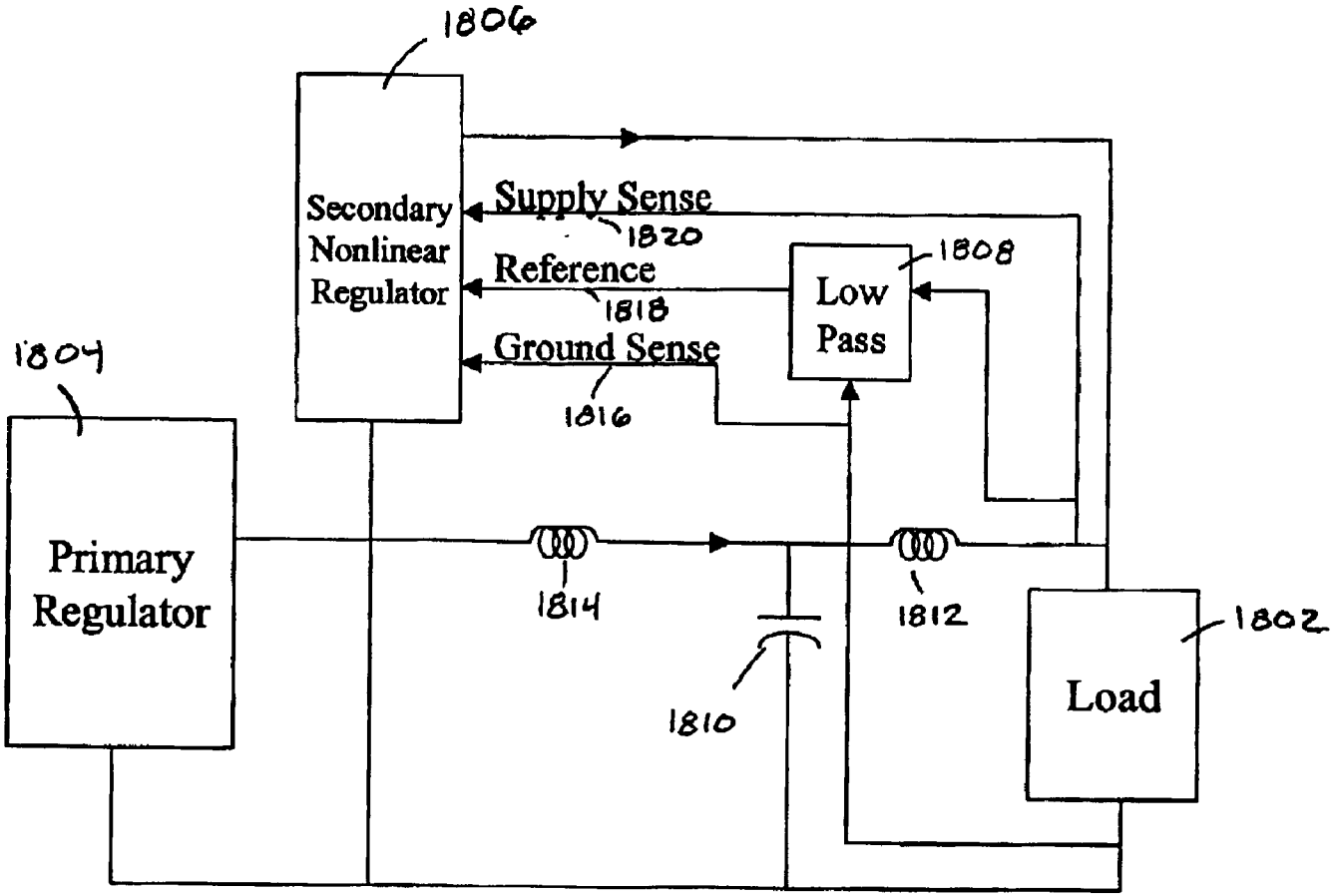
Figure 19:
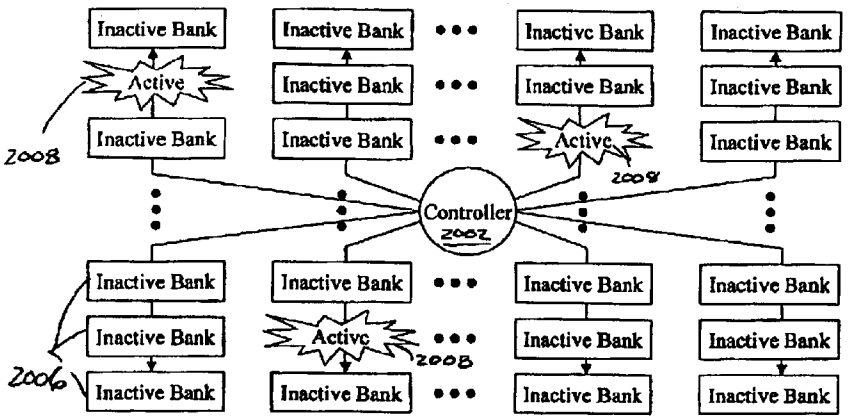
Figure 18:
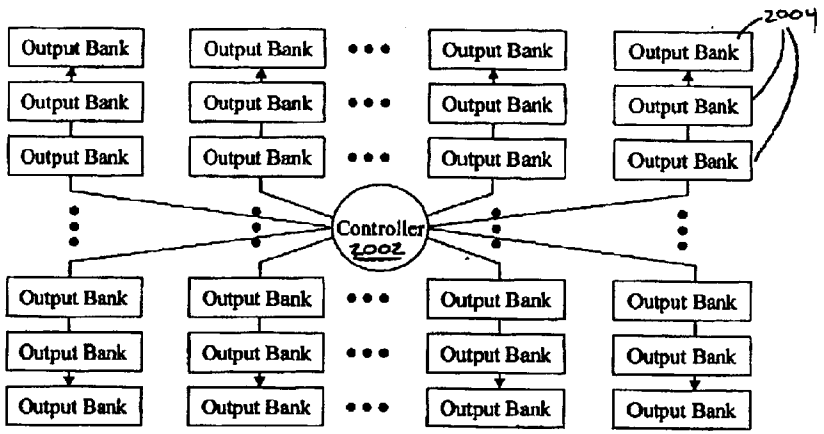
Figure 20:
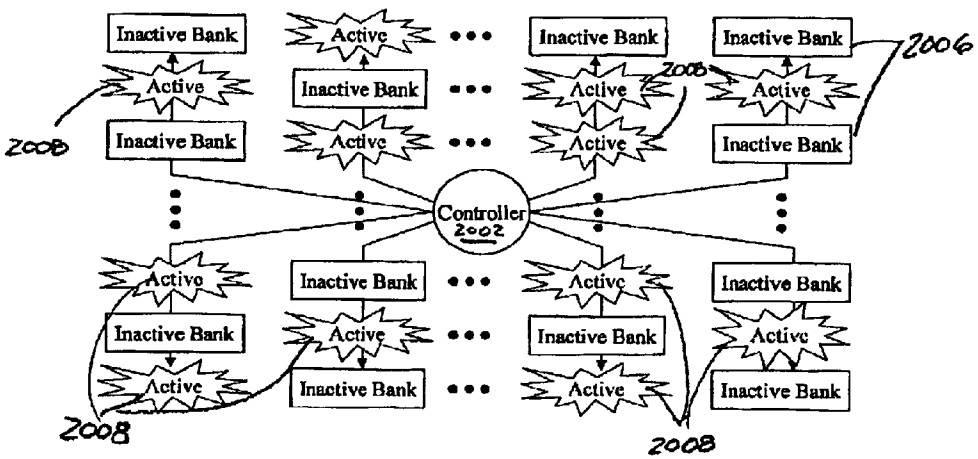

FIG. 5 presents exemplary waveforms depicting supply current droop;

FIG. 6 presents exemplary waveforms depicting the effect of a boost current supplied in response to a sudden current increase;

FIG. 7 presents exemplary waveforms depicting the effect of a high magnitude boost current;

FIG. 8 presents exemplary waveforms depicting the effect of a low magnitude boost current;

FIG. 9 presents exemplary waveforms depicting the combination of di/dt and voltage-sensed boost current;

FIG. 10 is a conceptual frequency regulation diagram showing exemplary coverage of various frequency ranges by the primary and secondary regulators;

FIG. 11 is a schematic diagram of a control scheme in accordance with the present invention;

FIG. 12 is a schematic diagram of a control scheme in accordance with the present invention;

FIG. 13 is a detailed schematic diagram of a circuit in accordance with one embodiment of the present invention;

FIG. 14 is a detailed schematic diagram of a circuit in accordance with one embodiment of the present invention;

FIG. 15 is a detailed schematic diagram of a circuit in accordance with one embodiment of the present invention;

FIG. 16 is a detailed schematic diagram of a circuit in accordance with one embodiment of the present invention;

FIG. 17 is a schematic overview of a primary/secondary regulator scheme in accordance with the present invention; and FIGS. 18–20 depict multiple output banks in accordance with another aspect of the present invention.

Those skilled in the art will appreciate that elements in the figures are illustrated for simplicity and clarity and have not necessarily been drawn to scale. For example, the dimensions of some of the elements in the figure may have been exaggerated relative to other elements to help to improve understanding of embodiments of the present invention.

DETAILED DESCRIPTION

The present invention provides a system for supplying current to a dynamic load subject to transient current requirements. In accordance with one embodiment of the present invention, a sense unit coupled to the dynamic load is configured to sense the rate of change of supply current required by the dynamic load during a transient event. A current source coupled to the sense unit is configured to supply a current pulse to the dynamic load in response to the sense unit determining that the rate of change of supply current (di/dt) exceeds a predetermined threshold. The current pulse preferably has a shape characterized by a first region and a second region subsequent to the second region, wherein the first region includes a first boost current which exceeds the transient current requirement, and wherein the second region includes a second boost current which is less than the transient current requirement.

In accordance with another aspect of the present invention, a wideband transient suppression system includes a primary regulator configured to compensate for low frequency transients, and a secondary regulator configured to provide short-term compensation current to the dynamic load until the primary regulator can accommodate the transient event. The secondary regulator includes two major functional blocks: a closed-loop voltage-sensing compensation circuit configured to compensate for transients falling within a mid-range frequency range, and an open-loop di/dt-sensing compensation circuit configured to compensate for transients falling within a high-frequency range.

Figure 1:
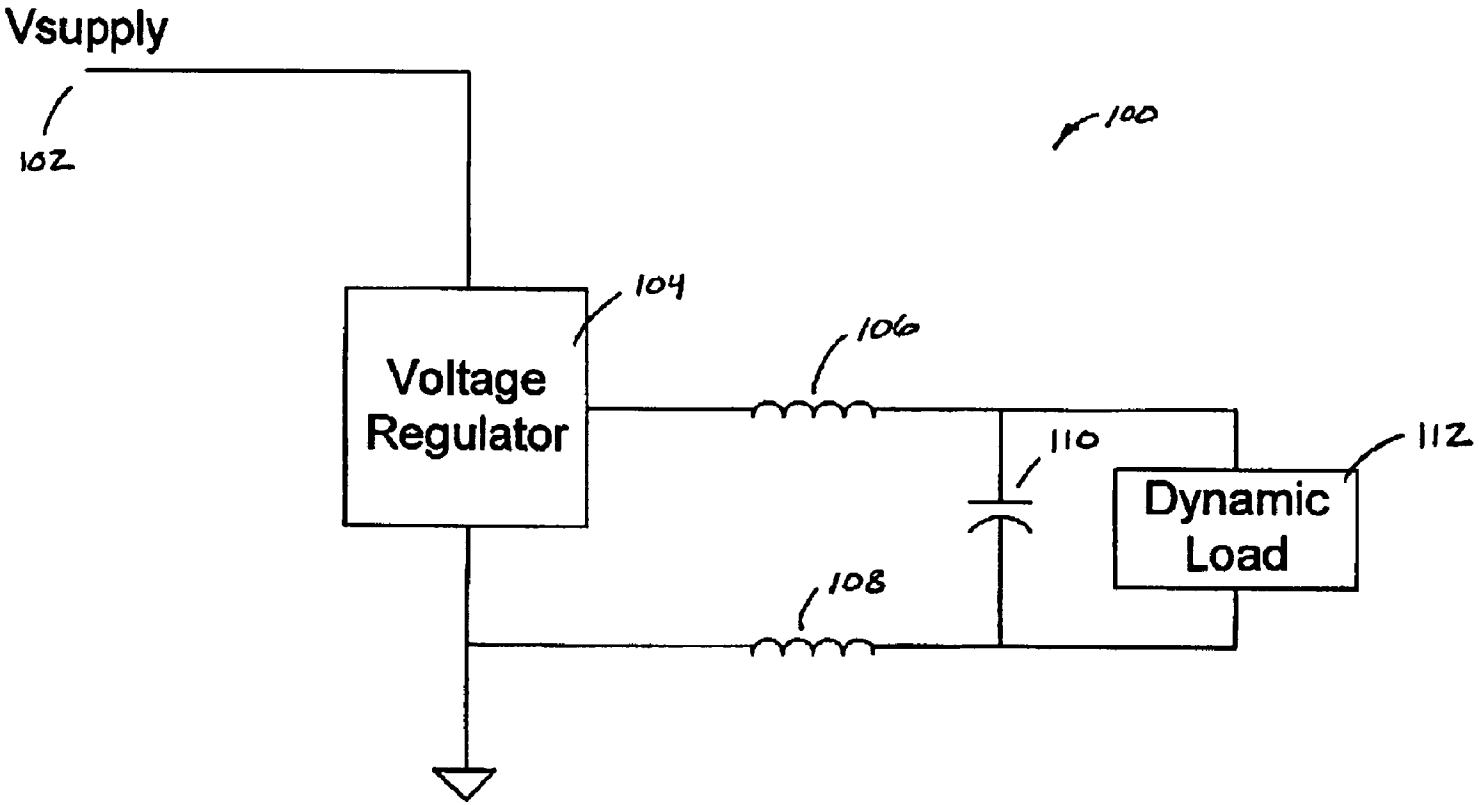
Figure 2:
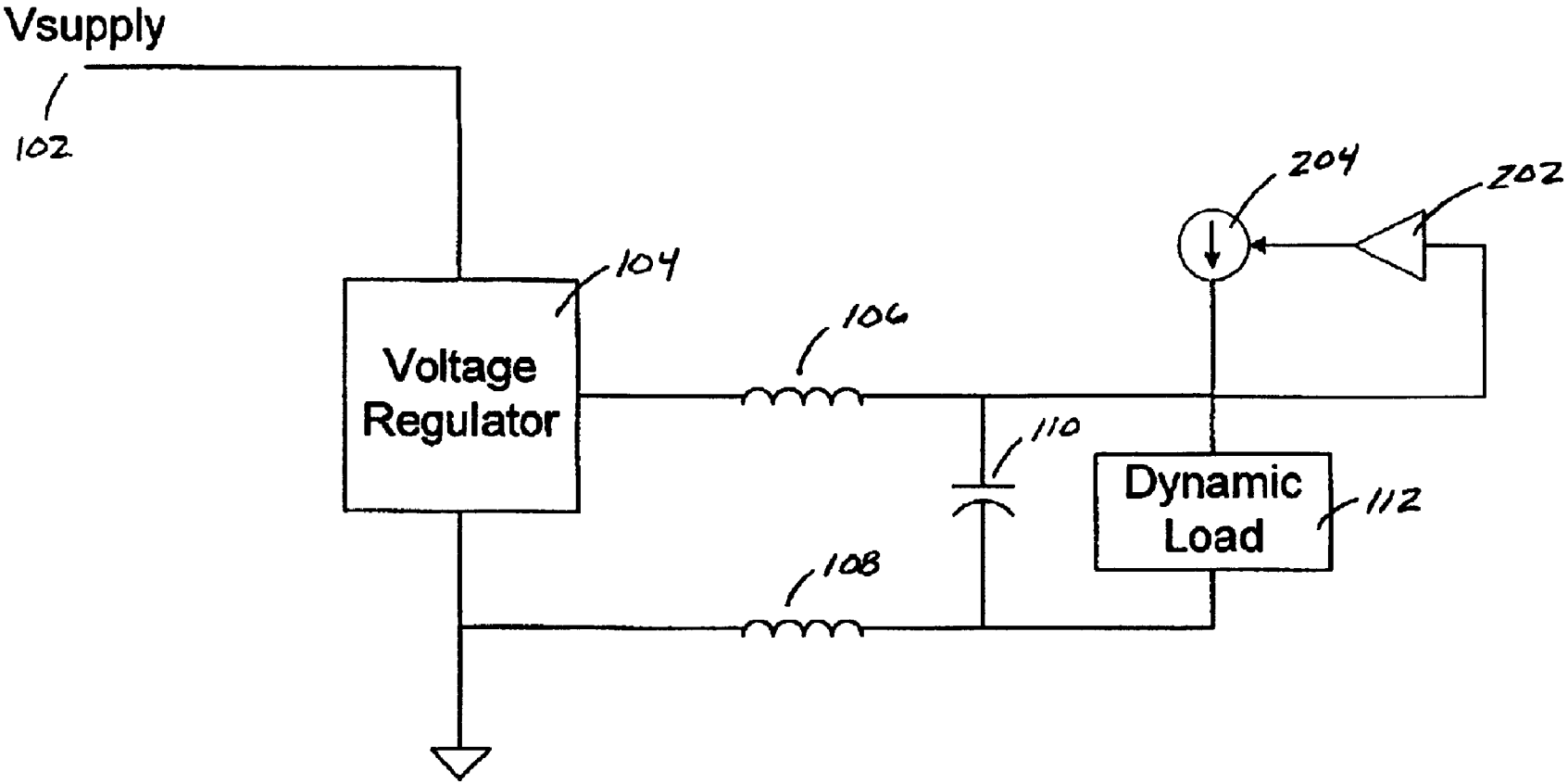
FIG. 2 is a schematic overview of a compensation circuit in accordance with one embodiment of the present invention.

Referring now to FIG. 2, a compensation circuit in accordance with one embodiment of the present invention comprises a current source 204 coupled to dynamic load 112. As shown in FIG. 1, dynamic load 112 is coupled to voltage regulator 104 through inductances 106 and 108, and bypass capacitor 110. Rather than attempting to provide a matched current to dynamic load 112 during a transient event (a matched current which would necessarily be late due to the delay in the sense circuit) the present invention momentarily supplies an excess amount of current to compensate for the voltage droop induced by the mismatch in load and source current. This is preferably accomplished by using a current compensation approach with pulse-shaped compensating current.

Figure 3:
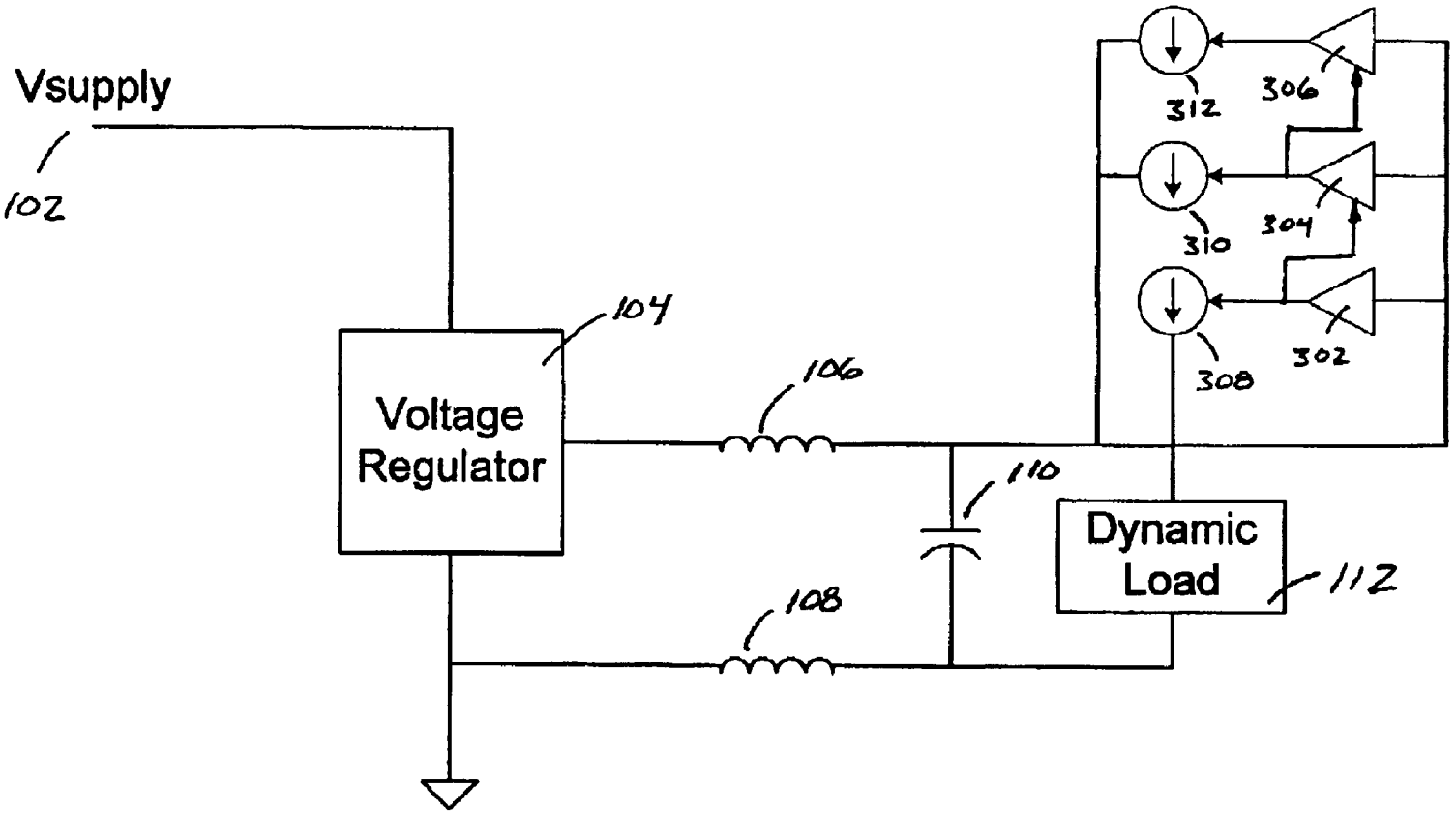
FIG. 3 is a schematic overview of a compensation circuit in accordance with an embodiment of the present invention that includes multiple current sources.

An alternate embodiment of the present invention includes multiple current sources with multiple corresponding sense units configured to provide sequential triggering. Such an embodiment is illustrated in FIG. 3, wherein multiple current sources 308, 310, and 312 are coupled to sense units 302, 304, and 306 respectively. Additionally, sense 306 is preferably coupled to the output of sense unit 304, and, likewise, sense 304 is coupled to the output of sense 302. It will appreciated that any number of such units may be provided, and that the three-source embodiment shown is not intended to limit the present invention.

Sequential triggering of sources 308, 310, and 312 may be accomplished in several ways. In accordance with one embodiment of the present invention, different thresholds are set for the various units. In accordance with another embodiment, sense units 302, 304, and 306 are cascaded with predefined trigger mechanisms such that each unit is dependent on the response of the previous unit. For example, second unit 310 outputs a current pulse only after first unit 308 has done so, and third unit 312 outputs a current pulse only after second unit 310 has been triggered. In accordance with yet another embodiment of the present invention, both multiple thresholds and trigger cascading are employed such that the granularity of response is further increased.

Thus, the second unit 310 will be triggered (and produce a pulse) only if needed. There are circumstances when the pulse of first unit 308 will be sufficient; in which case, only first unit 308 is used. In this way, the entire chain of units (308, 310, 312, etc.) will only fire in response to extreme transient events, providing a mechanism for adjusting the amplitude and duration of the compensation current to match the change in the dynamic load. This component of the response exhibits the speed of an open loop system while providing a self-limiting aspect (i.e., through sequential triggering) that is present in a closed-loop system.

In an alternate embodiment of that shown in FIG. 3, the shape, time-delay, and/or threshold of the pulses produced by the various current sources are varied to produce the desired composite pulse.

Figure 4:
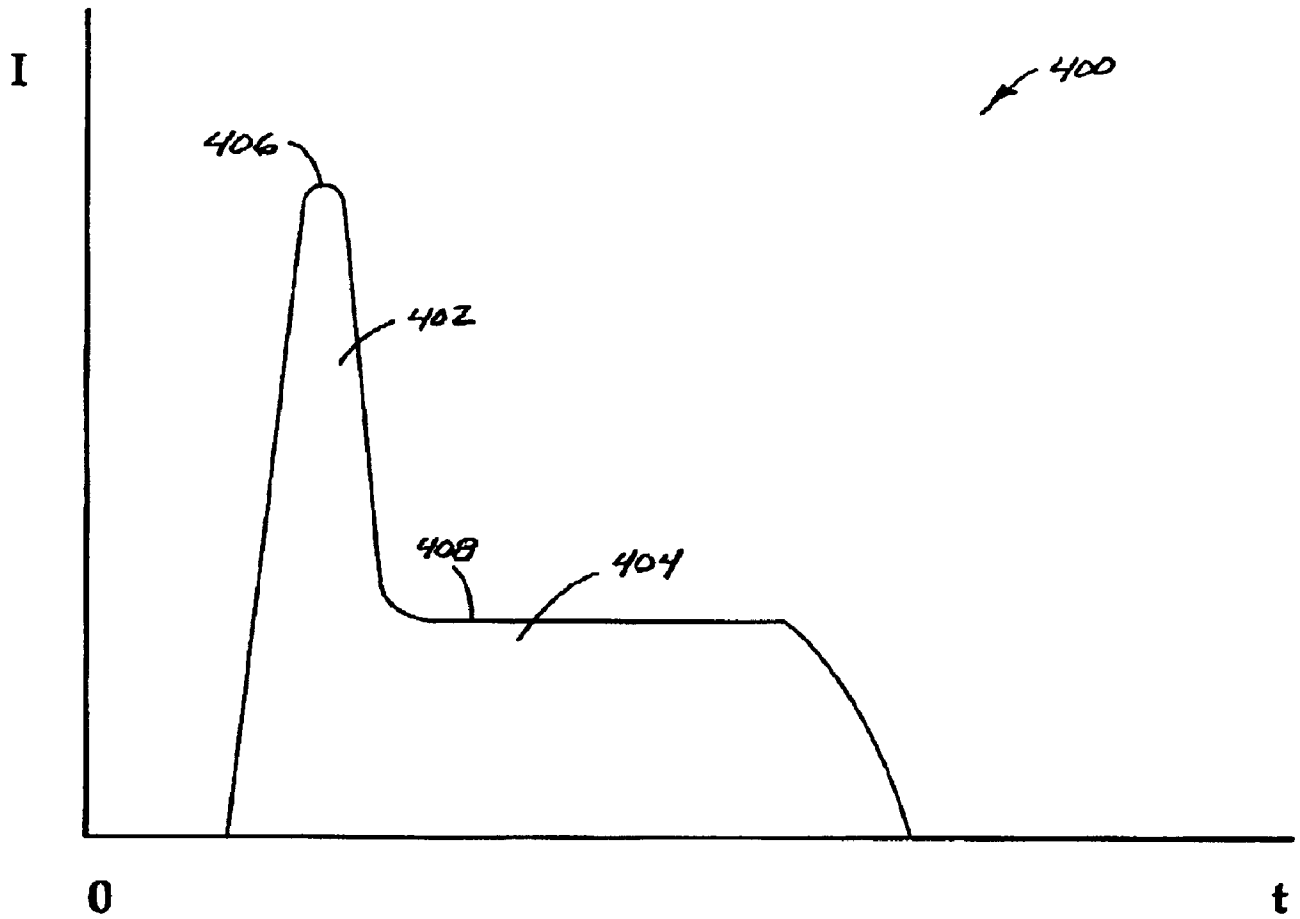
FIG. 4 is a graphical depiction of an exemplary pulse shape in accordance with the present invention.

FIG. 4 shows a conceptual overview of a current pulse shape 400 provided by current source 204 (or a collection of such sources) wherein an initial current pulse region 402 exceeds the change in dynamic load and a second pulse region 404 discharges over a longer time. The first region 402 includes a first boost current 406 which exceeds the transient current requirements, and the second region 404 includes a second boost current 408, which may or may not be substantially constant as illustrated, but which is less than the transient current requirement.

It will be appreciated that the time scale of FIG. 4 may vary depending upon the desired application, and that the various proportions of the pulse are also merely for illustrative purposes. In one example, the delay until the first boost current is applied is about 1.0 ns and the width of the first boost (region 402) is approximately 2 ns. The width of second region 404 will also vary, and might be on the order of 100–200 ns.

This pulse shaping allows the initial current compensation to exceed the change in dynamic load, thus restoring the supply voltage to closer to its regulated value and providing some additional margin until the voltage regulator (or "primary" regulator) 104 can compensate for the change in dynamic load current. In addition, if the compensating current does not exactly match the change in dynamic load current, restoring the supply voltage to closer to the center of its range allows a greater mismatch to be tolerated.

As described in detail below, one embodiment of the present invention includes circuitry wherein first region 402 of current pulse 400 is the result of an open-loop response to the transient current requirement (sensed, for example, via a di/dt value across a parasitic inductance), and wherein second region 404 of current pulse 400 is the result of a closed-loop response to the transient current requirement (sensed, for example, via the voltage across the load)

FIGS. 5–9 are useful in illustrating the manner in which a secondary regulator and primary regulator in accordance with the present invention may work in together to suppress undesired power supply voltage transients due to rapid changes in load conditions.

Referring now to FIG. 5, the function of the primary regulator is to provide the average current demanded by the load. For stability reasons, the bandwidth of the primary regulator is typically kept low, e.g., approximately 1 MHz or less. Thus, when the load current 504 changes suddenly (exhibiting a high di/dt 502), the supply current 508 from the primary regulator may be unable to respond quickly. An initial droop in load voltage 510 is caused by fast current changes through parasitic inductive elements between the supply and load. This voltage may be described by the equation V=L*di/dt. The error charge dQ (506) is the integral of the difference in current between the load 504 and the supply 508. By summing this amount of error charge into an equivalent capacitance via the equation dV=dQ/C, the error voltage, dV, can be calculated.

In order to react to fast transient events, a wideband secondary nonlinear regulator is preferably employed. To provide fast detection, the secondary nonlinear regulator is preferably located near the load to reduce any parasitic elements that may hinder reaction time. If the demand in load current suddenly increases, the secondary nonlinear regulator would source the requested current so that the supply voltage would not substantially drop. If the demand in load current suddenly drops, the secondary nonlinear regulator would sink the requested current so that supply voltage would not substantially overshoot. Consequently, the secondary nonlinear regulator takes over the regulation responsibility momentarily during fast load transient events.

The typical bandwidth of a di/dt sense method in accordance with the present invention is between approximately 500 MHz and 5 GHz. However, di/dt sensing provides a relatively poor magnitude response, and current provided by a secondary nonlinear regulator triggered from di/dt-sensed events cannot typically provide a sustained current. Furthermore, the output current should typically not cut off suddenly, as this would generate undesirable voltage spikes at the load.

FIG. 6 illustrates typical waveforms of currents and load voltage in a system with a di/dt sensing secondary nonlinear regulator and a low bandwidth primary regulator. As shown above in FIG. 5, a fast di/dt event 502 is followed by an increased load current 504. The supply current 508 provided by the primary regulator is consistent with its slow reaction time. With a first boost current 602 triggered via di/dt (and preferably with a controlled shut-off), the total supply current 520 is such that the initial response is adequate, and the integrated error charge 506 is consequently reduced as compared to FIG. 5.

FIG. 7 illustrates a regulation system in which the magnitude of the di/dt-sensed boost current 602 is higher than the demanded current 504. The result is an over-boost of output voltage 702 at the load. FIG. 8, on the other hand, depicts the situation where the magnitude of the di/dt-sensed boost current 602 is too low, and the initial droop in load voltage 510 may not be regulated sufficiently.

FIG. 9 shows the result of combining a high magnitude di/dt boost current 90 with a voltage-sensed boost current 904. As shown, the total supply current 520 momentarily overshoots load current 504 before settling into a steady-state value which corresponds to the sum of the di/dt boost current 902, the voltage sense boost current 904, and the primary regulator current 508. In many applications, however, this overboosting of voltage is not a great concern provided that the reliability of the devices making up the load are not compromised. Underboosting of voltage as shown in FIG. 8, however, may cause bit errors. Therefore, a preferred embodiment of the present invention allows the di/dt-sensed boost current to have a magnitude which is between about 70% and 100% of the maximum delta current the load may draw, and a voltage-sensed boost current which corresponds to the instantaneous dynamic load current minus the primary regulator current. The actual magnitude of the boost current may be proportional to the expected transient amplitude, or may be calculated based on any convenient criterion.

The di/dt-sensed regulation described above is capable of controlling the very high frequency responses. However, as shown in FIGS. 5–9, an error output voltage dV may still exist. In a preferred embodiment of the present invention, a handoff system is provided wherein the shutoff rate of the di/dt sensed boost current matches that of the turn-on rate of the primary regulator, thus providing a more optimal response and reducing the error voltage dV. This hand-off system can also be accomplished by implementing a handoff system with a voltage-sensed boost current in the secondary nonlinear regulator as shown in FIG. 17.

Specifically, primary regulator 1804 is coupled to load 1802 through inductances 1814 and 1812 as well as capacitor 1810. Secondary nonlinear regulator 1806 provides current to load 1802 in response to supply sense 1820, reference 1818, and ground sense 1816. A suitable low-pass filter 1808 may be employed as shown to generate the target reference 1818. In terms of bandwidth, primary regulator 1804 is typically a low-pass regulation system whose bandwidth is limited to about 1 MHz. The di/dt sensed current boost regulation system in secondary nonlinear regulator 1806 preferably has a high-pass reaction function, which typically regulates transient events in the frequency range of about 500 MHz and beyond.

A voltage-sensed boost current in secondary nonlinear regulator 1806, which is inherently slower than di/dt sensing and has a maximum bandwidth of about 1 GHz, can bridge the bandwidth gap between primary regulator 1804 and di/dt sensing regulation. Thus, full bandwidth regulation can be achieved as illustrated in FIG. 10, wherein the regulation bandwidth is partitioned into three regions: primary regulator 1002, secondary voltage-sensed regulator 1004, and secondary di/dt sensed regulator 1006. It will be appreciated that the frequency values and frequency band shapes shown in FIG. 10 are given for example purposes only, and that the present invention is not so limited.

In a preferred embodiment, the voltage-sensing regulation 1004 roll-on bandwidth is not lower than that of the primary regulator 1002. Otherwise, the voltage-sensing regulator would interfere with the primary regulator. To ensure that bandwidth overlap of the di/dt-sensed regulator 1006 and voltage-sensed regulator 1004 do not cause interference of regulation, activation of the voltage-sensed regulator 1004 may be configured to trigger a blanking of the di/dt sensing circuitry.

In this handoff mechanism, the secondary nonlinear regulator 1802 monitors the load voltage. If the voltage exceeds the predetermined thresholds, the secondary nonlinear regulator activates a boost current of the appropriate polarity to regulate the voltage. The secondary nonlinear regulator 1806 may then implement one or several threshold levels consisting of independently controlled boost current sources for different degrees of regulation. The bandwidth of the roll-off is typically within the regulation bandwidth of the voltage-sensed regulator.

When a fast transient event occurs, the secondary nonlinear regulator 1806 preferably detects the event via the di/dt sense and triggers a boost current. The boost current reaches a maximum magnitude and is preferably allowed to shutoff gradually. Subsequent regulation is carried out by sensing the voltage at the load. If the error voltage crosses preset thresholds, another boost current of proper polarity is activated.

The di/dt sensing circuitry may be configured to be blanked when the voltage-triggered boost current is activated to ensure no false triggering of the di/dt boost current. Thus, the load current demand is regulated by the combination of di/dt boost current, voltage sensed boost current, and the primary regulator current. The resultant supply voltage at the load exhibits minimal variations throughout the transient event.

Performance improvements using multi-threshold sensing can be achieved by using voltage interpolation to improve the granularity of the nonlinear regulator while reducing the load of the spreading ladder used to set the various thresholds. An exemplary methodology for multi-threshold sensing uses threshold interpretation, which can be used in connection with voltage regulation systems described herein. In such a system, a fully-differential implementation of the concept requires at least two voltage levels off the main reference and sense lines. The remaining voltages that are used for comparison purposes are generated by an interpolation level of resistors. Thus, the main sense and reference lines are not overly burdened by extraneous capacitances. In this manner, the loading caused by the resistors and comparators can be distributed, thus better retaining the bandwidth of the regulation operation. The generated thresholds can be either a current or a voltage and need not be uniform. Further, the thresholds can track with reference variation. Typical interpolated thresholds may be in the range of 1–50 mV. While this interpolation methodology is described in the context of voltage regulation, it should be understood that it may be used in a variety of different contexts in which various reference voltage levels are desired.

A method to improve the response of the regulator includes the use of a dual loop regulator, including a nonlinear wide-band loop combined with a traditional linear loop. In this regard, FIG. 11 shows an exemplary embodiment of a dual loop regulator, wherein voltage supply 102, voltage regulator 104, supply inductance 106, ground inductance 108, bypass capacitor 110, and dynamic load 112 are as described above. FIG. 11 also shows an additional supply inductance 1112 and an additional ground inductance 1114.

Voltage regulator 104 is supplemented by a second, wide-band voltage regulating loop comprising comparator 1116, comparator 1118, current source 1122, and current source 1120. When comparator 1116 senses that the voltage at dynamic load 112 has dropped past a certain amount, comparator 1116 signals current source 1122 to supply current to dynamic load 112, thus increasing the voltage. When comparator 1118 senses that the voltage at dynamic load 112 has increased by a certain amount, comparator 1118 signals current source 1120 to sink current from dynamic load 112, thus reducing the voltage.

In order to maintain loop stability with the dual-loop approach it is desirable to configure the system such that the wide-band loop has low gain for small excursions, large gain for large excursions, and finite energy storage capability such that large signal oscillations cannot be sustained. If the stability criteria is met, then the nonlinear wideband loop provides significant improvement in wideband transient suppression.

As described above, wideband transient suppression in accordance with the present invention relies on multiple sensing mechanisms, such as using both di/dt sensing and voltage sensing. Di/dt sensing may include a mechanism for sensing the change in current over time across an inductance by sensing the voltage drop across a parasitic inductance. Using the relationship of voltage being equal to the product of the inductance and di/dt ($V=L(di/dt)$), by sensing the voltage over an inductance, the change in current is sensed.

It is particularly advantageous to combine sensing mechanisms so that the advantages of each scheme can be exploited. In particular, as previously discussed, di/dt sensing provides an extremely fast response time, but provides very poor magnitude response, while voltage sensing provides a slower response time, but excellent magnitude control. Combined sensing provides the fast response of di/dt sensing and the excellent magnitude control of voltage sensing. The additional complexity of combined sensing is very low, because the area consuming output switch can be shared. Different switching characteristics can be achieved through appropriate design of the control circuitry (e.g. different switching speeds or control signal sharing).

FIG. 12 shows an example of a wideband nonlinear loop using combined di/dt sensing and voltage sensing, where the output devices (current sources 1122 and 1120) are shared between the two control elements. Comparators 1116 and 1118 are each connected to an appropriate reference voltage. For example, Comparator 1116 is connected to reference 1250, which is set at a predetermined slight negative offset from the desired reference, and comparator 1118 is connected to reference 1252, which is set at a predetermined slight positive offset from the desired reference.

The di/dt sensor comprises comparator 1202 and 1204 sensing the voltage across supply inductance 1112. As described above, a fast change in the current results in a voltage across supply inductance 1112. If more current is requested, comparator 1204 instructs current source 1122 to supply current to dynamic load 112. If less current is requested, comparator 1202 instructs current source 1120 to sink current from dynamic load 112. The di/dt sensor responds to fast changes in the dynamic load that may cause a voltage drop across the supply or ground parasitic inductance. This parasitic inductance might be due to power traces on the die, package, or board, or due to chip and package-attach effects caused by bond wires, flip chip bumps, leads, and/or package balls.

The voltage sensor responds to changes in the actual load voltage, which is indicative of a longer sustained change in the dynamic load current. The sensed voltage can be compared with a target voltage derived either from a voltage reference or a lowpass-filtered version of the regulated voltage, or AC-coupled so it responds only to changes over a certain bandwidth.

With reference to FIG. 13, an exemplary circuit 1600 will now be described. Load transients (from load 1650) are sensed by the sense amp 1644 (via current sense 1646), which in turn controls the operation of the Iboost control circuitry 1642 and 1648. The current sources Iboost1 1618 and Iboost2 1626 are configured to compensate for any load transients by either delivering or accepting a large amount of charge to the load through the output devices 1632 and 1634 (for Iboost1) and 1636 and 1640 (for Iboost2). The circuit also includes appropriate diodes 1620, 1622, 1628, and 1630, as well as a voltage source 1604 acting in conjunction with amp 1612 and associated resistors 1606, 1608, and 1610. The output of amp 1612 drives both transistors 1616 and 1634. An additional current source 1624 (Ibias2) provides additional current in connection with Iboost2. (1626). By using the di/dt sensing methodology, the system can detect and respond to instantaneous events very quickly, i.e., events which cannot be handled by primary regulator 1602.

FIG. 7 shows a more detailed implementation in accordance with one embodiment of the present invention. In illustrated circuit 1700, di/dt sensing is accomplished by monitoring voltage across inductor 1784. Inductor 784 may be a discrete inductor, trace inductance, pin inductance, or any other suitable parasitic inductance connected in series with load 1750.

Ibias1 1772 and diode 1770 bias the output device 1734 at a low current on-state during standby. When there is a sudden increase of current in load 1750, a positive voltage is generated across inductor 1784. The di/dt sense amp 1786 detects the event and signals Iboost Control 1*a* 1742 to enable current source Iboost1*a* 1718. This current is suitably amplified by diodes 1720 and 1722 and transistor 1732, whereupon charge is delivered through output device 1734 to load 1750.

Since output device 1734 is partially on during standby, the response time of this process is reduced. Meanwhile the voltage sense amp 1788 monitors the voltage status at load 1750 and relays the information to Iboost Control_1*b* 1754. If the voltage falls below one or more predetermined levels, Iboost Control_1*b* 1754 asserts current source Iboost1*b* 1756 and resumes delivering charge to the load via diodes 1758 and 1760, transistor 1716, and output device 1734. If the load voltage is at an acceptable level, Iboost Control 1*b* 1754 disables current source Iboost1*b* 1756 and the delivery of charge to the load terminates.

One advantage of this topology is that the output device 1734 can be shared between the two states of operation. Because devices 1732 and 1716 are connected in an OR-tied configuration, output charge can be delivered in a controlled fashion. Maximum output charge remains the same for the cases of the assertion of Iboost1*a* 1718 or Iboost1*b* 1756 or both. Furthermore, since the two charge delivery mechanisms are independently controlled, response characteristics, such as gain, sensitivity, and response time, of Iboost Control_1*a* 1742 and Iboost Control_1*b* 1772 can be optimized individually to best regulate the system.

The operation of the circuit where there is a sudden drop in current demand from the load is similar. During standby, Ibias2 1724 and diode 1778 bias the output device 1740 at a low current-on state. When a sudden drop in load current occurs, a negative voltage is generated across inductor 1784. The di/dt sense amp 1786 detects the event and signals Iboost Control_2*a* 1748 to assert current source Iboost2*a* 1726. This current is amplified through diodes 1780 and 1782 and transistor 1736, and charge is diverted from the load via output device 1740. Meanwhile, voltage sense amp 1788 monitors the voltage status at load 1750 and relays the information to Iboost Control_2*b* 1752. If the voltage rises over one or more predetermined levels, Iboost Control_2*b* 1752 asserts current source Iboost2*b* 1762 and resumes diverting charge from the load via diodes 1764 and 1766, transistor 1774, and output device 1740. If the load voltage is at an acceptable level, Iboost Control_2*b* 752 de-asserts current source Iboost2*b* 1762 and the diversion of charge from the load terminates. Maximum output charge diversion control is accomplished by connecting device 1736 and device 1774 in an OR-tied configuration to drive shared output device 1740. Hence, maximum output charge remains the same for the cases of the assertion of Iboost2*a* 1726 or Iboost2*b* 1762 or both.

An additional PNP embodiment of the circuit shown in FIG. 14 is shown in FIG. 15, where circuitry of the embodiment of FIG. 14 that responds to sudden increase in load current (e.g., circuitry including and surrounding transistors 1734, 1732, and 1716) has been replaced with a PNP equivalent of the circuitry that responds to sudden drop in load current. Similarly, another alternative embodiment of the circuit of FIG. 14 is shown in FIG. 16. In this embodiment, circuitry in FIG. 14 that responds to a sudden drop in load current (e.g., circuitry including and surrounding transistors 1740, 1736, and 1774) have been replaced with a PNP equivalent.

An alternate embodiment of the circuit of FIG. 14 includes a circuit wherein all of the NPN transistors and diodes are replaced with NMOS transistors and diode-connected NMOS transistors. A further embodiment includes a circuit wherein all of the NPN transistors are replaced with NMOS devices and all of the PNP transistors are replaced with PMOS devices. These and other embodiments using various combinations of conventional electronic components are also comprehended by the present invention.

In accordance with another aspect of the present invention, the output device may comprise several smaller output devices distributed into multiple banks to improve thermal dissipation. More particularly, referring now to FIGS. 18–20, each bank 2004 may be configured to deliver a predetermined amount of output current. Furthermore, each bank of the output device can be controlled independently by a controller 2002 such that one or more banks 2004 of devices may be asserted at the same time.

During conditions when the load is demanding less than maximum current, some of the banks 2004 may be turned off to reduce output delivery (e.g., banks 2006 in FIG. 19). Controller 2002, which may comprise any convenient microprocessor, microcontroller, dedicated logic, or the like, is configured to determine which banks of output devices are active. As load demand changes, controller 2002 responds by activating or deactivating output banks to match the load condition.

FIG. 19 illustrates an exemplary configuration when load demand is light; i.e., there are only a few output banks to deliver a moderate amount of current. In contrast, FIG. 20 illustrates the above configuration when the load is heavy. More output banks 2008 are activated to supply the higher current demand of the load.

To improve reliability of the output devices, controller 2002 preferably rotates active banks to ensure that no single bank is overstressed by prolonged operation. Controller 2002 may use an internal state machine to reassign the active output banks. Controller 2002 may also rotate active banks to ensure that all banks receive substantially the same usage. Alternatively, controller 2002 may comprise temperature-sensing devices distributed alongside the output devices to detect excessive heating at local areas and to thereby determine optimum reassignments. In this manner, banks that become overheated receive less usage than banks operating at normal temperatures.

The present invention has been described above with reference to preferred embodiments. However, those skilled in the art will recognize that changes and modifications may be made to the preferred embodiments without departing from the scope of the present invention.

What is claimed is:

1. A system for supplying current to a dynamic load subject to a transient current requirement, said system comprising:

a sense unit coupled to said dynamic load, said sense unit configured to sense the rate of change of supply current required by said dynamic load during said transient current requirement;

a current source coupled to said sense unit and said dynamic load, said current source configured to supply a current pulse to said dynamic load in response to said sense unit determining that said rate of change of supply current exceeds a predetermined threshold;

said current pulse having a shape characterized by a first region and a subsequent second region, wherein said first region includes a first boost current which exceeds said transient current requirement, and wherein said second region includes a second boost current whose amplitude is less than said transient current requirement.

2. The system of claim 1, wherein said first region of said current pulse is the result of an open-loop response to said transient current requirement.

3. The system of claim 1, wherein said second region of said current pulse is the result of a closed-loop response to said transient current requirement.

4. The system of claim 1, wherein said sense unit senses a di/dt value across a parasitic inductance.

5. The system of claim 1, wherein said sense unit senses a voltage across the load.

6. The system of claim 1, further including at least one additional current source and at least one sense unit configured to provide sequential triggering to produce said current pulse.

7. The system of claim 1, further comprising a plurality of current sources and a plurality of respective sense units corresponding to a plurality of multiple thresholds.

8. The system of claim 7, wherein a plurality of additional thresholds are obtained through interpolation of said multiple thresholds.

9. A power supply system comprising:

a plurality of output banks coupled to a dynamic load subject to a transient current requirement;

a controller coupled to said plurality of output banks, said controller configured to control said output banks such that said output banks are either active output banks or inactive output banks;

each of said output banks comprising:

a sense unit coupled to said dynamic load, said sense unit configured to sense the rate of change of supply current required by said dynamic load during said transient current requirement;

a current source coupled to said sense unit and said dynamic load, said current source configured to supply, when said output bank is an active output bank, a current pulse to said dynamic load in response to said sense unit determining that said rate of change of supply current exceeds a predetermined threshold;

said current pulse having a shape characterized by a first region and a subsequent second region, wherein said first region includes a first boost current which exceeds said transient current requirement, and wherein said second region includes a second boost current whose amplitude is less than said transient current requirement.

10. The system of claim 9, wherein said controller preferably rotates said output banks between active output banks and inactive output banks to prevent overstressing said output banks due to prolonged operation.

11. The system of claim 9, wherein said controller implements an internal state machine to reassign said active output banks.

12. The system of claim 9, wherein said controller rotates said output banks between active output banks and inactive output banks to ensure that all banks receive substantially the same usage.

13. The system of claim 9, wherein said controller further comprises temperature-sensing devices configured to detect excessive heating associated with the positions of said output banks and to reassign said active output banks in accordance with said excessive heating.

14. The system of claim 9, wherein said sense unit comprises a current sense circuit and a voltage sense circuit, and wherein said voltage sense circuit and said current sense share one of said output banks.

15. A wideband transient suppression system for controlling a dynamic load subject to transient current requirements, said system comprising:

a primary regulator configured to compensate for transients below a first frequency;

a secondary regulator, said second regulator including:

a voltage-sensing compensation circuit configured to compensate for transients between said first frequency and a second frequency;

a di/dt-sensing compensation circuit configured to compensate for transients above said second frequency.

16. The system of claim 15, wherein said first frequency is approximately 1 MHz, said second frequency is between approximately 500 MHz and 1000 MHz.

17. The system of claim 15, wherein said di/dt-sensing unit senses a di/dt value across a parasitic inductance.

18. The system of claim 15, wherein said voltage-sensing unit senses a voltage across the load.

19. A method for supplying current to a dynamic load subject to a transient current requirement, said method including the steps of:

a) sensing the rate of change of supply current required by said dynamic load during said transient current requirement;

b) supply a current pulse to said dynamic load in response to said sense unit determining that said rate of change of supply current exceeds a predetermined threshold, wherein said current pulse has a shape characterized by a first region and a subsequent second region, wherein said first region includes a first boost current which exceeds said transient current requirement, and wherein said second region includes a second boost current whose amplitude is less than said transient current requirement.

20. The method of claim 19, wherein said first region of said current pulse is the result of an open-loop response to said transient current requirement.

21. The method of claim 19, wherein said second region of said current pulse is the result of a closed-loop response to said transient current requirement.

22. The method of claim 19, wherein said sensing step includes sensing a di/dt voltage across the load.

23. The method of claim 19, wherein said sensing step includes sensing a voltage across a parasitic inductance.

24. The method of claim 19, further including the step of providing at least one additional current source and at least one additional sense unit configured to provide sequential triggering to produce said current pulse.

* * * * *